US009429365B2

(12) United States Patent
Postma et al.

(10) Patent No.: US 9,429,365 B2
(45) Date of Patent: Aug. 30, 2016

(54) HEAT EXCHANGER TUBE SHEET, A HEAT EXCHANGER AND A METHOD OF MANUFACTURING A HEAT EXCHANGER TUBE SHEET

(75) Inventors: Ron Postma, Voorburg (NL); Bart Jan Van Den Berg, Utrecht (NL); Robert Sakko, Vlaardingen (NL); Hans Constant Dikhoff, Eindhoven (NL)

(73) Assignee: HEATMATRIX GROUP B.V., Vugit (NL)

( * ) Notice: Subject to any disclaimer, the term of this patent is extended or adjusted under 35 U.S.C. 154(b) by 701 days.

(21) Appl. No.: 13/696,227

(22) PCT Filed: May 6, 2011

(86) PCT No.: PCT/EP2011/057332

§ 371 (c)(1),
(2), (4) Date: Jan. 16, 2013

(87) PCT Pub. No.: WO2011/138444

PCT Pub. Date: Nov. 10, 2011

(65) Prior Publication Data

US 2013/0105127 A1 May 2, 2013

(30) Foreign Application Priority Data

May 6, 2010 (EP) ..... 10162177

(51) Int. Cl.
*F28D 1/053* (2006.01)
*F28D 7/16* (2006.01)
(Continued)

(52) U.S. Cl.
CPC ..... *F28D 1/053* (2013.01); *B21D 53/02* (2013.01); *F28D 7/16* (2013.01); *F28F 9/14* (2013.01); *F28F 2255/14* (2013.01);
(Continued)

(58) Field of Classification Search
CPC ..... B23C 39/10; B23C 70/84; B23C 70/845; F28F 1/00; F28F 1/08; F28F 2009/226; F28F 2255/14; F28F 2255/146; F28F 9/02; F28F 9/04; F28F 9/165; F28F 9/22
USPC ..... 165/158
See application file for complete search history.

(56) References Cited

U.S. PATENT DOCUMENTS 3,426,841 A 2/1969 Johnson
4,117,884 A * 10/1978 Frei ..... F28F 9/162 165/175
4,323,115 A * 4/1982 Stafford ..... F28F 21/067 165/158

(Continued)

FOREIGN PATENT DOCUMENTS

DE 1 601 185 7/1970
EP 0 117 821 A2 9/1984

(Continued)

*Primary Examiner* — Jacob Cigna
(74) *Attorney, Agent, or Firm* — Birch, Stewart, Kolasch & Birch, LLP

(57) ABSTRACT

In a method of manufacturing a heat exchanger tube sheet sealing elements are arranged on respective ends of heat exchanger tubes. Said ends of the heat exchanger tubes having the sealing elements are arranged at predetermined positions in a mold. Said ends of the heat exchanger tubes are sealed such that a tube sheet material to be casted in the mold does not enter the heat exchanger tubes during casting of the tube sheet material. A tube sheet material is casted in the mold for covering the sealing elements. The tube sheet material is hardened in the mold.

20 Claims, 13 Drawing Sheets

(51) Int. Cl.
*F28F 9/14* (2006.01)
*B21D 53/02* (2006.01)

(52) U.S. Cl.
CPC ..... *F28F 2265/26* (2013.01); *Y10T 29/49368* (2015.01); *Y10T 29/49373* (2015.01)

(56) References Cited

U.S. PATENT DOCUMENTS 4,623,017 A * 11/1986 Oda ..... B01D 46/24 165/158
5,323,849 A 6/1994 Korczynski, Jr. et al.
5,759,500 A 6/1998 Garner et al.
5,865,244 A * 2/1999 Moser ..... B29C 45/14614 165/173
6,719,037 B2 * 4/2004 Crook ..... F02B 29/0456 165/178
6,964,297 B1 11/2005 Janezich et al.
2004/0045438 A1 * 3/2004 Place ..... B01D 53/0438 95/141
2005/0051314 A1 3/2005 Heier
2009/0008074 A1 1/2009 Vamvakitis et al.
2010/0012296 A1 * 1/2010 Cox ..... F28D 7/16 165/104.19

FOREIGN PATENT DOCUMENTS

EP 1 422 488 A2 5/2004
EP 1 422 489 A2 5/2004
FR 2 356 494 1/1978
JP S58-117998 A 7/1983
JP S62-108999 A 5/1987
JP H01-226314 A 9/1989
JP H03-48846 B2 7/1991
JP 3140963 U 3/2008
WO WO 82/02015 A1 6/1982
WO WO 93/04333 A1 3/1993
WO WO 02/27256 A2 4/2002

* cited by examiner

HEAT EXCHANGER TUBE SHEET, A HEAT EXCHANGER AND A METHOD OF MANUFACTURING A HEAT EXCHANGER TUBE SHEET

The present invention relates to a method of manufacturing a heat exchanger tube sheet, a heat exchanger tube sheet, and a heat exchanger provided with such a tube sheet.

The standard way of separating the shell and tube side fluids of a heat exchanger at the end of the tubes is by means of a tube sheet. The tubes are inserted into through bores provided in the tube sheet and are subsequently welded to the tube sheet to create a tight seal. In order to allow thermal expansion of the tubes a flexible bellow is provided between the circumference of the tube sheet and the outer shell of the heat exchanger. A heat exchanger of this type is often referred to as floating head heat exchanger, an embodiment of which is known from U.S. Pat. No. 5,759,500. A known disadvantage of the floating head type heat exchanger is the sensitivity of the floating head bellow to thermal fatigue cracking due to normal expansion during temperature cycles.

EP 1422488 discloses an alternative solution for thermal expansion of the tubes by introduction of a pressure seal system per tube in the tube sheet. A tube is allowed to slide in axial direction through an O-ring which is pressurized by a threaded ring nut in order to provide tight sealing. It is obvious that such a system requires a significant amount of parts which makes it cumbersome and impractical to apply in larger heat exchangers with hundreds or thousand of tubes.

A specific example of a tube sheet for a heat exchanger made of plastic material is disclosed in U.S. Pat. No. 3,426,841. The plastic tubes in the plastic tube sheet are surrounded by a plastic sleeve element extending from the tube sheet holes, which is fused to the tube end. Although the plastic sleeve element creates a flexible tight seal between tube sheet and tube, it is a very fragile part of this plastic heat exchanger and requires a significant amount of welding.

It is obvious that the designs and assembling processes discussed above are complicated, cumbersome, laborious, time-consuming and therefore expensive, offering a suboptimal final product with respect to accommodating thermal expansion between the tubes and shell of a heat exchanger.

An object of the present invention is to provide an improved method of manufacturing a heat exchanger tube sheet.

More particularly, it is an object to provide a method of manufacturing a tube sheet which creates a tight seal between heat exchanger tube and shell side fluids while at the same time allowing expansion of each individual tube.

Yet another object is to provide an easy method of manufacturing a tube sheet without the need for subsequent pipe welding, rolling or mounting of screwed ring nuts and alike.

Yet another object is to provide a method of manufacturing a tube sheet which is especially suitable for heat exchangers made of plastic to accommodate the increased thermal expansion of plastic tubes compared to any other construction material.

Yet another object is to provide an improved heat exchanger tube sheet.

According to a first aspect of the invention one or more objects are achieved by a method of manufacturing a heat exchanger tube sheet, comprising:

arranging sealing elements on respective ends of heat exchanger tubes, arranging said ends of the heat exchanger tubes having the sealing elements at predetermined positions in a mould, sealing said ends of the heat exchanger tubes such that a tube sheet material to be casted in the mould is prevented from entering the heat exchanger tubes during casting of the tube sheet material, casting a tube sheet material in the mould for covering the sealing elements, hardening the tube sheet material in the mould.

After hardening of the tube sheet material, the tube sheet comprising hardened tube sheet material and the heat exchanger tubes with the sealing elements can be integrally removed from the mould.

Thus, the sealing elements are positioned at predetermined positions in the mould by positioning the sealing elements on the ends of the heat exchanger tubes at predetermined longitudinal or height positions with respect to said ends. Then, said ends of the heat exchanger tubes are arranged in the mould. Said ends are subsequently temporarily sealed such that the tube sheet material to be casted in the mould cannot enter the heat exchanger tubes during casting of the tube sheet material in the mould. After sealing said ends, the tube sheet construction material is cast in the mould for covering or submersing the sealing elements, in other words to a thickness sufficient for retaining the sealing elements. As the ends of the heat exchanger tubes are sealed during casting of the tube sheet material in the mould, the tube sheet material being cast cannot enter the interior of the heat exchanger tubes at said ends. This method according to the invention allows for an easy way of manufacturing a tube sheet having a plurality of embedded sealing elements.

The positioning of the sealing elements on the ends of the heat exchanger tubes at predetermined positions allows for an accurate individual arrangement of the sealing elements, e.g. in view of a staggered arrangement of the sealing elements in order to obtain a dense stack of tubes. For example, the undersized sealing elements are forced over the outer surface of the tubes and are subsequently positioned in an imaginary plane perpendicular to the tubes. The elements are preferably exactly aligned with the imaginary plane, most preferably in two or more imaginary planes in an alternating overlapping order to create a more compact heat exchanger. The alternating positioning of elements is within the thickness of the tube sheet to be casted.

The temporary sealing of said ends of the heat exchanger tubes during the manufacturing method according to the invention ensures that the tube sheet material cannot enter into the heat exchanger tubes during casting. The sealing of said ends may be accomplished in various manners, for example by pressing said ends against the bottom of the mould. It is possible that the tubes or stack of tubes are positioned vertically in a mould having the required tube sheet dimensions and shape. Advantageously the bottom of the mould is made of a non-binding material with respect to the tube sheet and tube construction material in order to seal the inside of the tubes and to allow easy removal from the mould, preferably silicon rubber. Optionally reinforcing materials such as fibers or fiber mat or metal reinforcements are positioned in the mould. Then liquid epoxy resin is poured into the mould to the desired thickness. After curing and removal from the mould a tube sheet is obtained which is provided with the stack of tubes is a sealing manner.

Surprisingly it was found that certain combinations of tube sheet construction material and tube construction material do not bind during the curing step. An example of non-binding behaviour is a tube sheet made of epoxy resin with aluminum oxide (alumina) powder filler or a tube sheet made of epoxy resin reinforced with fibres, such as glass fibres or carbon fibres, and heat exchanger tubes made of polypropylene. However, the tubes may be made of another plastic material or metal. The sealing elements can be made from various materials. For example, each sealing element comprises fluoropolymer and/or a synthetic rubber, such as ethylene propylene diene monomer (EPDM) rubber or nitrile butadiene rubber (NBR), and/or silicones. The non-binding property allows the tube to slide through the tube sheet and embedded sealing elements. The same manufacturing steps can be applied for manufacturing a similar tube sheet at the other side of the stack of tubes.

In an alternative embodiment the ends of the heat exchanger tubes are temporarily sealed during casting in the following manner. A layer of a sealing material, such as silicon rubber, is cast into the mould so that the end portions of the tube ends are immersed. After the sealing material has been allowed to cure, a layer of the tube sheet construction material is cast on top of the layer of cured sealing material and also allowed to cure. Subsequently, the layer of cured sealing material is removed, for example by tearing or peeling off the hardened sealing material from the hardened tube sheet material and said ends of the heat exchanger tubes or by cutting the hardened sealing material together with end portions of said ends of the heat exchanger tubes.

It is also possible that a metal insert is arranged in the mould, wherein the metal insert comprises a plurality of through holes, and wherein end portions of said ends of the heat exchanger tubes having the sealing elements are inserted into the through holes of the metal insert, and wherein, when the end portions of said ends have been inserted into the through holes of the metal insert, said ends of the heat exchanger tubes are sealed by the sealing elements sealing the heat exchanger tubes and the metal insert with respect to each other, and wherein the tube sheet material is cast onto the metal insert for covering the sealing elements and portions of the heat exchanging tubes extending above the sealing elements. After hardening of the tube sheet material, the tube sheet comprising the metal insert and the hardened tube sheet material and the heat exchanger tubes with the sealing elements can be integrally removed from the mould.

The metal insert may be made, for example, of steel, stainless steel or aluminium. In this case, the plastic part of the tube sheet is reinforced by the metal insert. The body of the tube sheet obtained by this method is constituted by a plastic body part and a metal body part. The plastic part may comprise, for example, epoxy resins bonded to the metal part. The metal part increases the strength and stiffness of the entire tube sheet and allows the plastic part to be less thick.

When the heat exchanger tubes are made of metal, for example stainless steel, the sealing elements may be used for alignment of the heat exchanger tubes to the centre of the through holes. In the case of an alumina reinforcement of the tube sheet and a stainless steel tube, the O-ring is also used to align the stainless steel tube in the centre of the aluminum part of the tube sheet thereby preventing direct contact between the different metals, which could otherwise lead to galvanic corrosion. The advantage of preventing galvanic corrosion is also achieved when the tube and plastic material have binding properties.

It is possible that the through holes each comprise a lower portion having a first internal diameter, a connection portion extending radially from the lower portion, and an upper portion extending from the connecting portion and having a second internal diameter which is greater than the first internal diameter, wherein the external diameter of the heat exchanger tubes is smaller than the first internal diameter, and wherein the external diameter of the sealing elements arranged on said ends of heat exchanger tubes is greater than the first internal diameter and smaller than the second internal diameter. Thus, the through holes in the metal insert define a stepped connecting portion, which forms a shoulder or stop for the sealing elements when inserting the heat exchanger tubes with the sealing elements in the through holes. This leads to accurate positioning of the sealing elements and also to reliable sealing of the ends of the heat exchanger tubes during casting.

The tube sheet obtained by the method according to the invention is capable of accommodating individual expansion of each tube. As a result, the tube sheet itself may be fixedly connected to the shell. Therefore in a preferred embodiment of the method according to the invention a shell is positioned in the mould, prior to casting. Thus the stack of tubes and heat exchanger shell are both positioned vertically in the mould during casting in the manufacturing process. Upon casting the tube sheet, the tube sheet and shell are integrally connected to each other.

It is also possible that the outside surfaces of the tubes are treated with a non-binding substance, like for example silicon oil or a non-binding foil, to prevent binding of tube construction material and tube sheet construction materials that do not have the non-binding properties by nature.

Optionally, the tube sheet is casted around a stack of tubes, which are provided with a corrugated part in longitudinal direction. The tube sheet obtained by this method provides a tight seal between the heat exchanger tubes and the tube sheet and simultaneously allows for thermal expansion of each individual tube. The corrugated part of the tube will be compressed as result of thermal expansion, which limits the forces on the tube sheet. This embodiment is preferably applied when bonding occurs between the tube and tube sheet construction material. The O-ring in this embodiment has only a secondary function in the case that the bonding between tube and tube sheet fails over time. Preferably the tube sheet with tubes having a corrugated part are casted without O-rings around the tubes and with a heat exchanger shell positioned in the mould.

According to a second aspect the invention relates to a heat exchanger tube sheet for holding heat exchanger tubes in a sealed manner, the sheet comprising a body of a plastic material having a first main surface and an opposite second main surface, the body comprising a plurality of through holes, each through hole being defined by a peripheral hole wall extending from the first main surface to the opposite second main surface, and the peripheral hole wall being provided with a peripheral recess, and wherein a resilient sealing element is accommodated in the peripheral recess, the sealing element protruding from the peripheral recess into the through hole, wherein the through holes extend in the body substantially parallel to each other, and wherein the peripheral recesses of adjacent through holes are staggered with respect to each other in the axial direction of the through holes.

In this case, a tube sheet for tight sealing and expansion of heat exchanger tubes is provided, comprising a body, usually a planar body such as a rectangular plate, having a first main surface or plane and an opposite second main surface or plane. The sheet body comprises a plastic material like epoxy resins, because of the advantageous corrosion resistant properties, anti-fouling characteristics, ease of manufacture and strenght. The body may be made of a plastic body part and a metal body part. The body is provided with a plurality of through holes or bores, one through hole for each tube to be mounted. Each through hole is defined by a peripheral hole wall, extending through the body from the first plane to the opposite second plane. The through hole has a cross-section, preferably a circular cross-section. Advantageously the cross-section of the through hole is constant in the longitudinal direction of the through hole, except for the peripheral recess. However, a slightly tapered through hole, for example, is also a suitable embodiment. A peripheral recess, such as an annular groove, is provided in the peripheral hole wall. The peripheral recess is sized such that it is able to retain a sealing element. The opening of the recess is advantageously fully comprised in the peripheral wall, although it may extend to one plane of the tube sheet body. A sealing element, preferably an O ring, made from a resilient and/or compressible material, is retained in the recess. The recess may be undercut. The sealing element may have a thickness larger than the opening width of the recess such that the peripheral wall encloses the sealing element for the greater part preventing the sealing element from being removed from the recess. Thus the sealing element is embedded in the recess. The sealing element has an inner cross section smaller than the inner cross section of the through bore, as a result of which the sealing element extends from the recess into the through bore, allowing to sealingly engage the respective heat exchanger tube that has an outer cross section larger than the inner cross section of the sealing element. Thus, the sealing elements may provide an interference fit for the heat exchanger tubes.

The properties of the sealing element, in particular its resilience and compressibility, provide tight sealing at the outer surface of the tube creating a barrier between the upstream and downstream side. The composite material which surrounds the sealing element has been manufactured, e.g. casted into the shape of the required tube sheet dimensions. The overall dimensions of the tube sheet depends on heat exchanger shell dimensions. In particular, its thickness depends on the required strength and pressure rating. Advantageously the plastic parts of the tube sheet can be reinforced with reinforcing materials, for example particulates like glass fiber and/or carbon fiber, and/or powders like alumina and silica. A preferred composite material is an epoxy resin comprising alumina powder. The embedded sealing elements in the tube sheet body extend the fluid barrier around the outer surface of the tube in perpendicular direction establishing a tube sheet that separates tubes side and shell side fluids once connected to the heat exchanger shell. The resilient engagement, but tight sealing between the sealing element and body allows unlimited thermal expansion of the tubes relative to the shell. Thus, a tube sheet is provided which accommodates individual expansion of each tube. The construction material of the body and construction material of the tubes are preferably selected in a way that no binding occurs during the manufacturing process, as will be explained below.

In an embodiment of the tube sheet according to the invention the through holes extend in the body substantially parallel to each other, and wherein the peripheral recesses of adjacent through holes are staggered with respect to each other in the axial direction of the through holes. The recesses of adjacent through bores are staggered in the thickness direction of the body. In this case, it is possible that in projection the recesses of adjacent through bores mutually overlap partially. This allows a compact arrangement of the heat exchanger tubes, wherein the tubes are arranged parallel at a distance less than two times the depth of a recess.

The invention also relates to a heat exchanger comprising a shell having inlets and outlets for the fluids to be heat exchanged, a stack of a plurality of heat exchanger tubes, at least one end of the tubes being retained in a heat exchanger tube sheet according to present invention as defined above, the tubes having an outer cross section larger than the inner cross section of the sealing elements of the heat exchanger tube sheet.

The various embodiments of the tube sheet as described above similarly apply to the heat exchanger according to the present invention. Preferably, the tubes are made of a plastic material. More particularly, the tubes are made of a plastic material that does not bind to the material of the body of the heat exchanging tube sheet and that does not bind either to the material of the sealing elements. An advantageous combination is a body made of epoxy resin reinforced with alumina powder or fibres, such as glass fibres or carbon fibres, and tubes made of polypropylene. The sealing elements can be made from various materials. For example, each sealing element comprises fluoropolymer and/or a synthetic rubber, such as ethylene propylene diene monomer (EPDM) rubber or nitrile butadiene rubber (NBR), and/or silicones.

In a further embodiment the outer surface of the tubes is provided with a non-binding coating, i.e. a coating that prevents a binding between the construction material of the body and sealing element on the one hand and the construction material of the tubes on the other hand. For example, the coating may comprise a fluid containing silicones and/or non-binding foil. A non-binding fluid can easily be applied to the outer surface of the tubes.

In an embodiment, the tube ends are provided with mechanical stops for preventing the tube ends to become detached from the tube sheet. This prevents the tube ends from travelling during repeated cycles of (thermal) expansion thereby avoiding release of the tube from the sealing engagement in the tube sheet.

The invention also relates to a heat exchanger tube sheet for retaining heat exchanger tubes in a sealed manner, the sheet comprising a body of a plastic material having a first main plane and an opposite second main plane, the body comprising a plurality of through bores, each through bore being defined by a peripheral wall, extending from the first plane to the opposite second plane, the peripheral wall being provided with a peripheral recess, wherein a resilient and compressible sealing element is retained, the sealing element having a thickness (t) larger than the opening width (b) of the recess and the sealing element having an inner cross section smaller than the inner cross section of the through bore. This heat exchanger tube sheet may be designed according to one or more of the features of the claims and/or according to one or more of the features mentioned in this description.

The invention will be further described in more detail by reference to the attached drawing, wherein.

Figure 1:
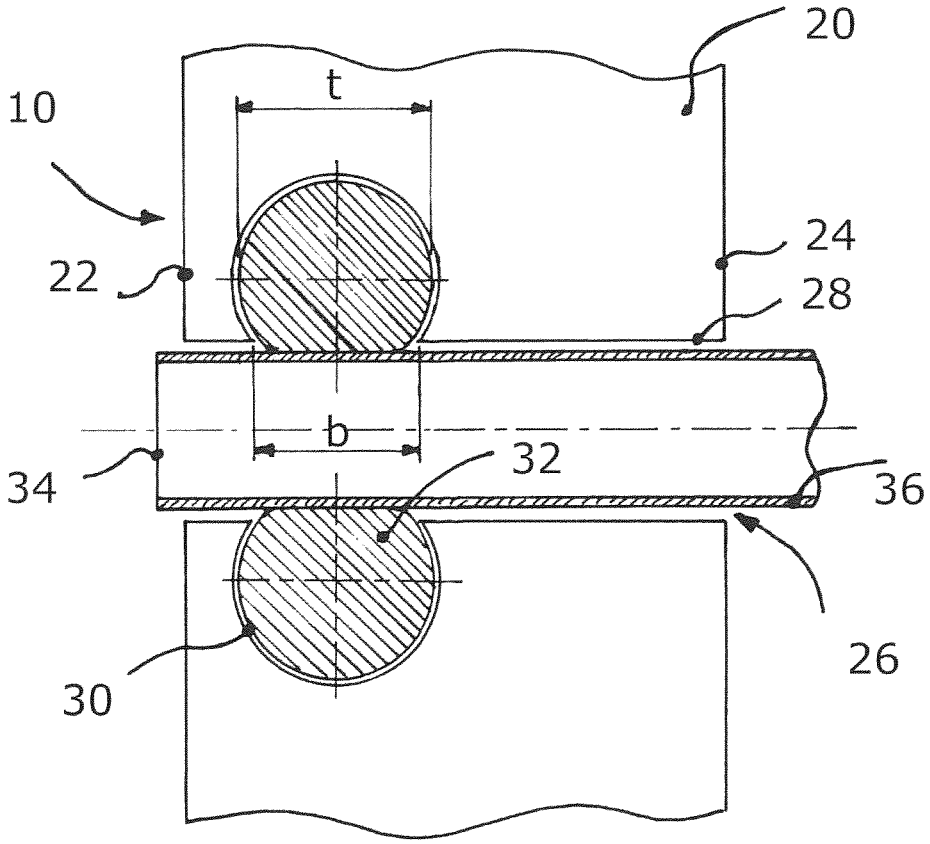
FIG. 1 shows a cross-section of an embodiment of a tube sheet according to the invention.

FIG. 1 shows a cross section of an embodiment of the tube sheet with embedded sealing elements, here O-rings. The tubesheet is indicated in its entirety by reference numeral 10. Tube sheet 10 comprises a rectangular sheet body 20 made of composite material. The body 20 has a first main plane 22 and a parallel opposite second main plane 24. FIG. 1 shows a cylindrical through bore 26 extending between the main planes 22 and 24. The through bore 26 is delimited by a peripheral wall 28. In the embodiment shown the peripheral wall 28 is provided with a circumferential recess 30. The recess 30 has—viewed in the longitudinal direction of the through bore 26—opening width b in the peripheral wall 28. An O-ring 32 is embedded in the recess 30. The thickness t of the O-ring 32 is larger than the opening width b of the recess 30. The inner diameter of the O-ring is smaller than the inner diameter of the through bore 26. One end 34 of a heat exchanger tube 36 is inserted in the through bore 26 and is sealingly engaged by the O-ring, thereby providing at the outer surface of the tube a barrier between upstream and downstream side of the tube 36. Due to the non-binding properties of composite material and tube construction material during the manufacturing process the tube 36 is allowed to slide through the through bore 26 and the O-ring 32 in order to absorb thermal expansion.

Figure 2:
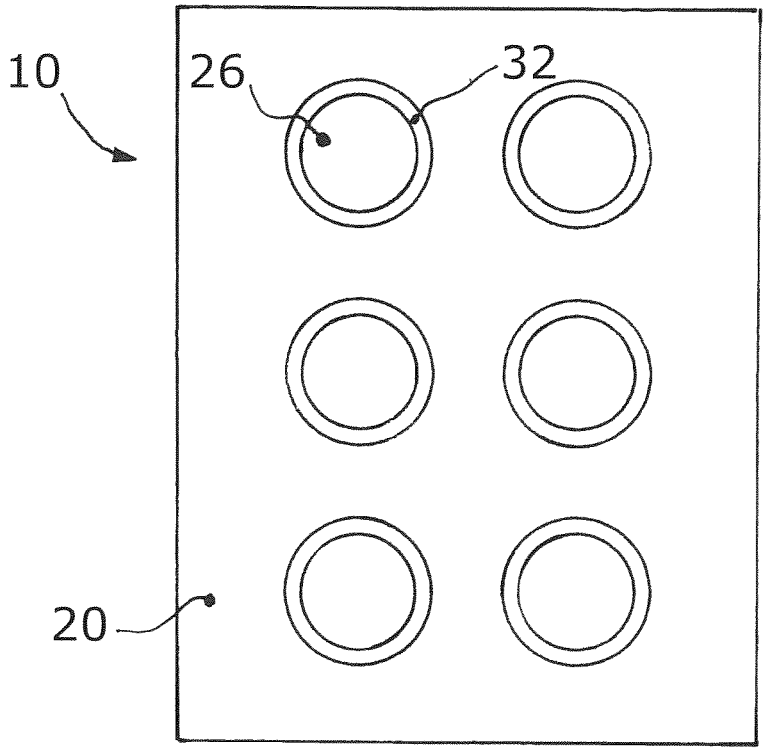
FIG. 2 shows a front view of an embodiment of a tube sheet according to the invention.

FIG. 2 shows a front view of an embodiment of a tube sheet 10 according to the invention without tubes 36.

Figure 3:
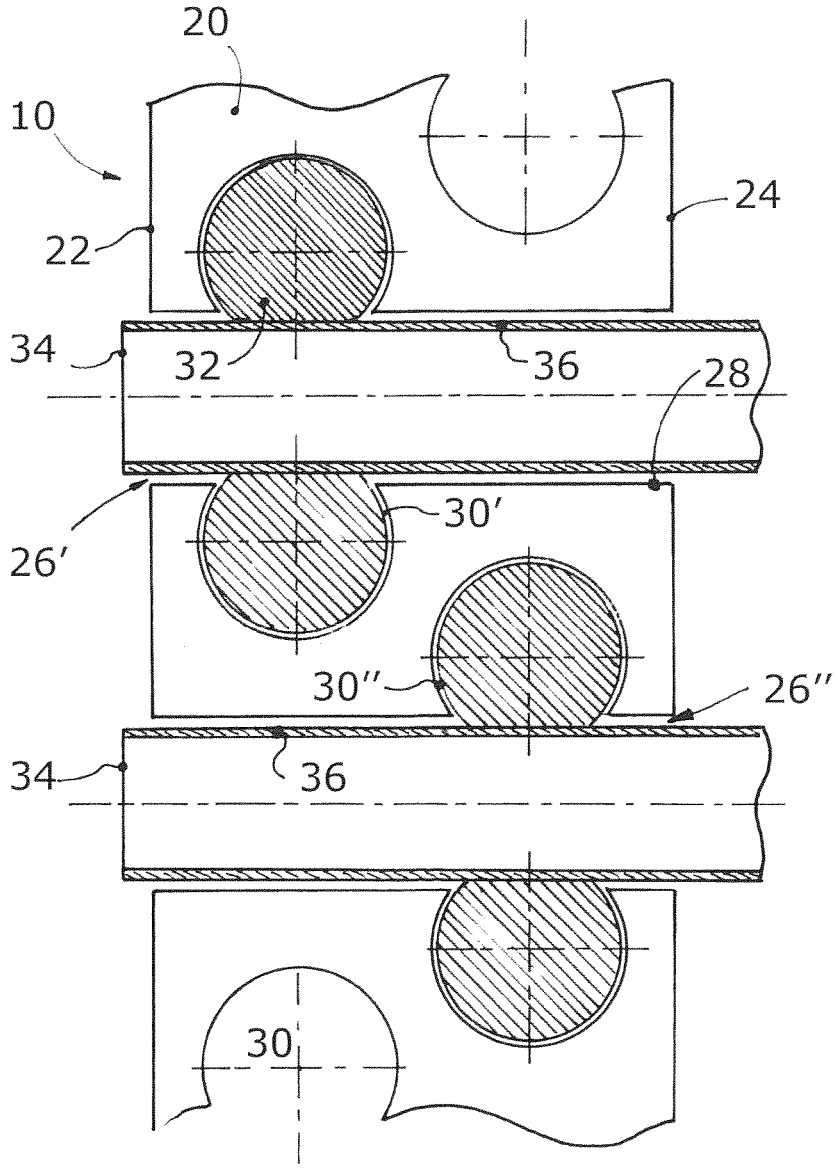
FIG. 3 shows another embodiment of an embodiment of a tube sheet according to the invention.

FIG. 3 shows a similar view of an embodiment of a tube sheet 10. However, in order to achieve a compact stack of heat exchanger tubes 36 the recesses 30 of adjacent through bores 26 partially overlap each other as seen in projection. This is achieved e.g. by positioning the recess 30' of a first through bore 26' in a first plane parallel to the main planes 22 and 24 of the sheet body 20, and the recesses 30" of surrounding through bores 26" in a second plane parallel to the first plane. In other words the recesses are staggered. The inner diameter of the O-rings 32 is smaller than the outer diameter of the tubes 36 and the inner diameter of the through bores 26.

FIG. 4 *a-f* show a tube sheet manufacturing method according to the invention. In FIG. 4*a* undersized O-rings 32 are positioned around the outer surface of the tubes 36 at one end 34 thereof. Multiple tubes 36 packed together, called a stack 40 of tubes 36, are vertically placed in a tray like mould 42 of the required tube sheet dimensions on the bottom 44. The lower ends of the tubes 36 are pressed against the bottom 44 so as to seal the interior of the tubes 36 with respect to the mould 42. Liquid epoxy resin is poured into the mould 42 to a predetermined height extending above the level of the O-rings 32 and allowed to cure. During the curing step the tube sheet body 20 is formed around the O-rings 32 and tubes 36. Due to the non-binding properties of the epoxy resin and the tube construction material no fixed connection between the tubes on the one hand and the body and O-rings on the other hand is established. As a last step mould 42 is removed from tube sheet 10 or vice versa (see FIG. 4*c*).

Figure 4A:
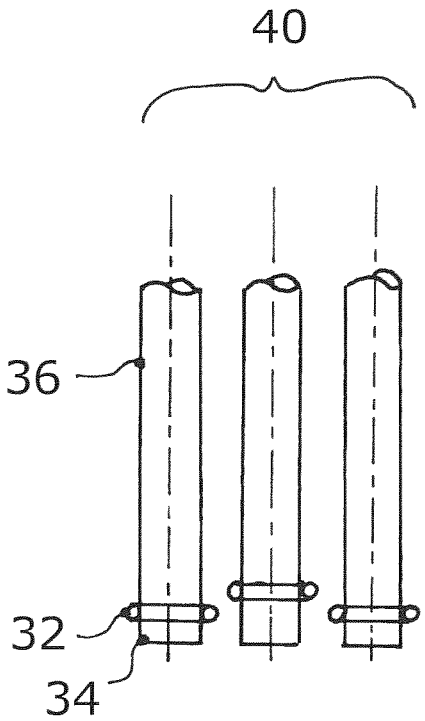
FIG. 4 shows an embodiment of the tube sheet manufacturing method according to the invention.
Figure 4B:
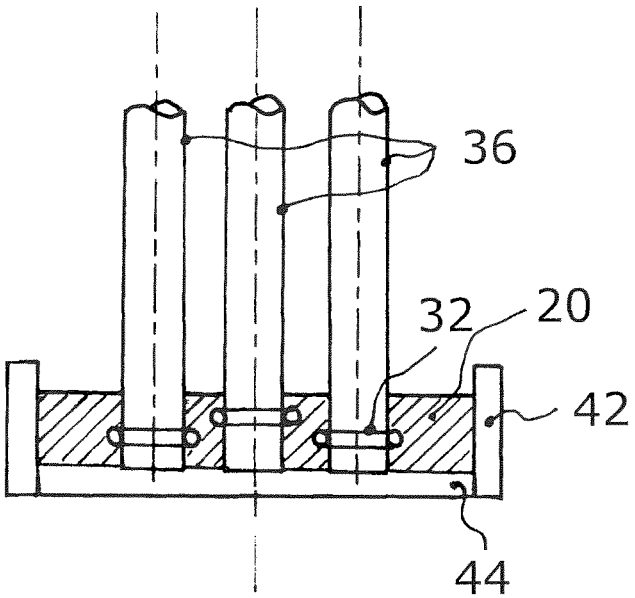
Figure 4C:
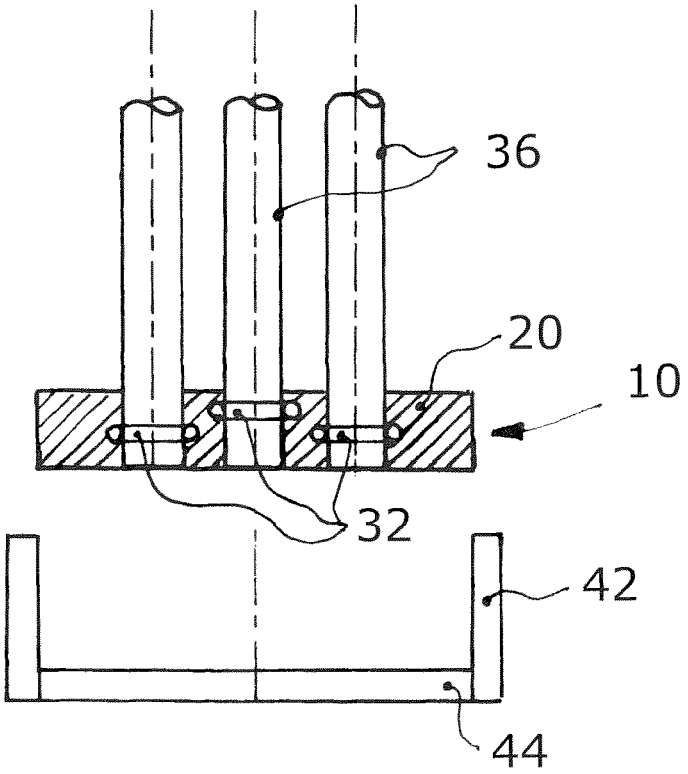
Figure 4D:
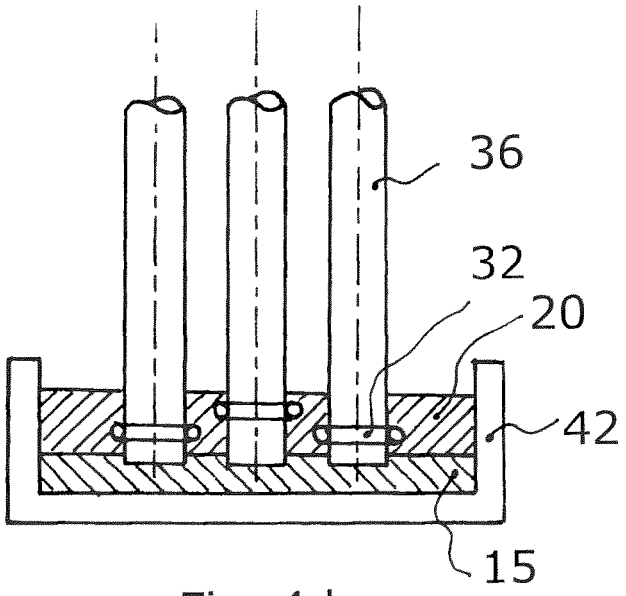
Figure 4E:
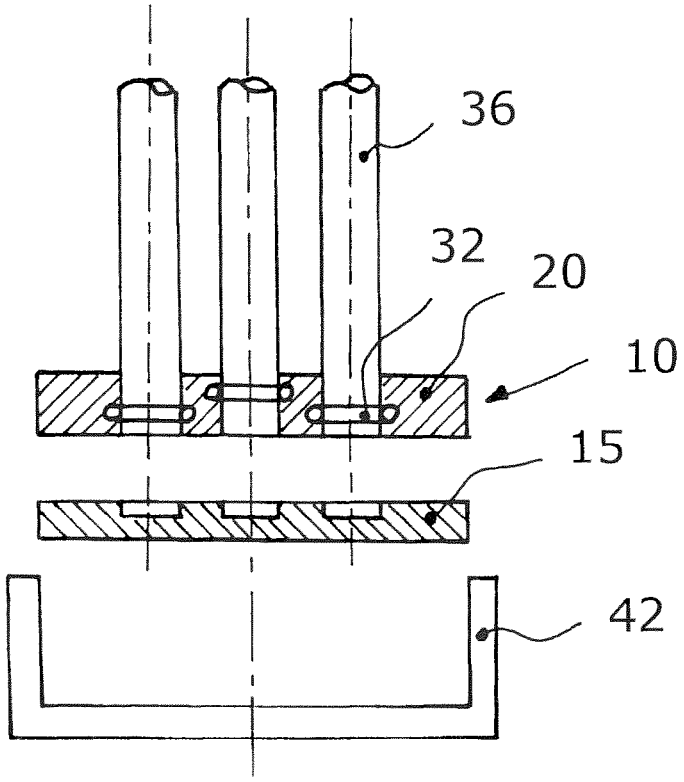
Figure 4F:
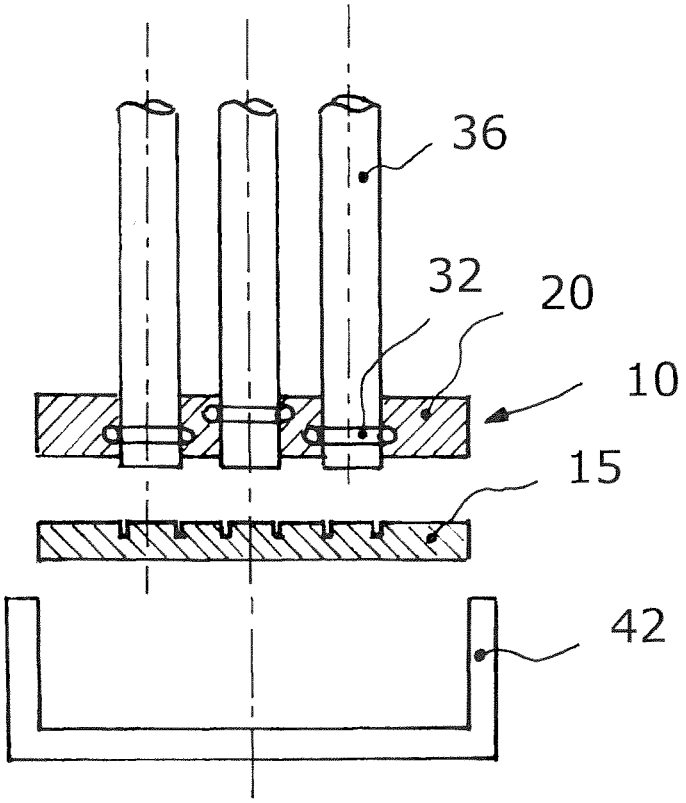

As shown in FIGS. 4*d, e* and *f*, it is also possible to cast a layer of a sealing material 15, such as silicon rubber, into the mould so that the end portions of the tube ends are immersed in the silicon rubber. After the silicon rubber 15 has cured, a layer of the tube sheet construction material is cast on top of the layer of cured silicon rubber and also allowed to cure. Then, the layer of cured silicon rubber 15 is removed. For example, the layer of cured silicon rubber 15 is removed together with end portions of the tube ends by cutting away the cured silicon rubber 15 and the end portions from adjacent portions of the tube ends (FIG. 4*e*). Alternatively, the cured silicon rubber 15 can be pulled off from the cured tube sheet construction material and the tube ends (FIG. 4*f*).

Figure 5:
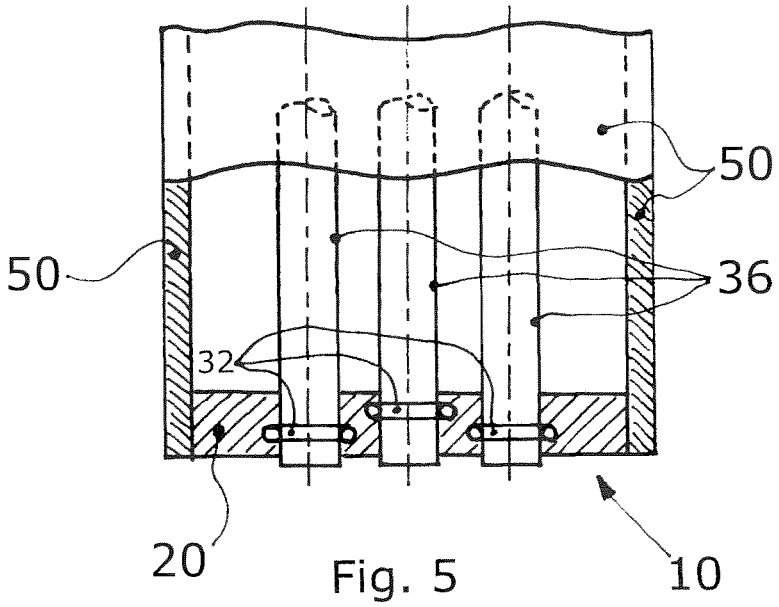
FIG. 5 shows a further embodiment of the manufacturing method according to the invention.

FIG. 5 shows a further embodiment of the manufacturing method according to the invention similar to FIG. 4, but further including casting a heat exchanger shell 50 together with the stack of tubes 40 to the tube sheet 10 during the second step of the manufacturing process.

Figure 6:
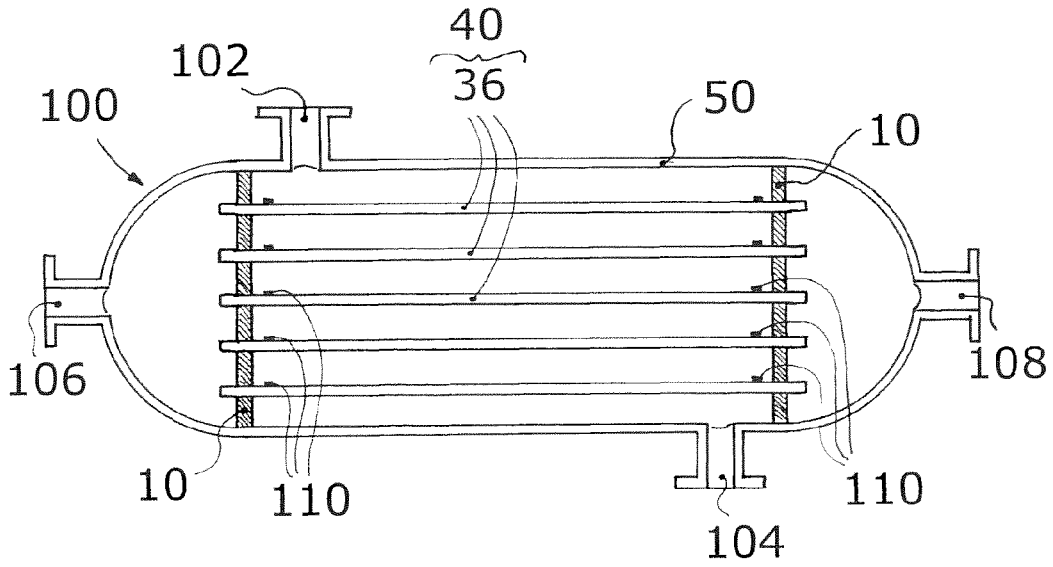
FIG. 6 is a schematic representation of a heat exchanger according to the invention.

FIG. 6 shows a schematic representation of an embodiment of a shell and tube heat exchanger 100 having a shell 50 as housing provided with an inlet 102 for supplying a heat exchanging fluid, e.g. seawater, an outlet 104 for discharge thereof, as well as an inlet 106 for feeding a product flow to be cooled or heated and corresponding outlet 108. The tubes 36 of the stack 40 are provided with mechanical stops 110 for preventing detachment thereof from the tube sheet 10 during thermal expansion cycles.

Figure 7:
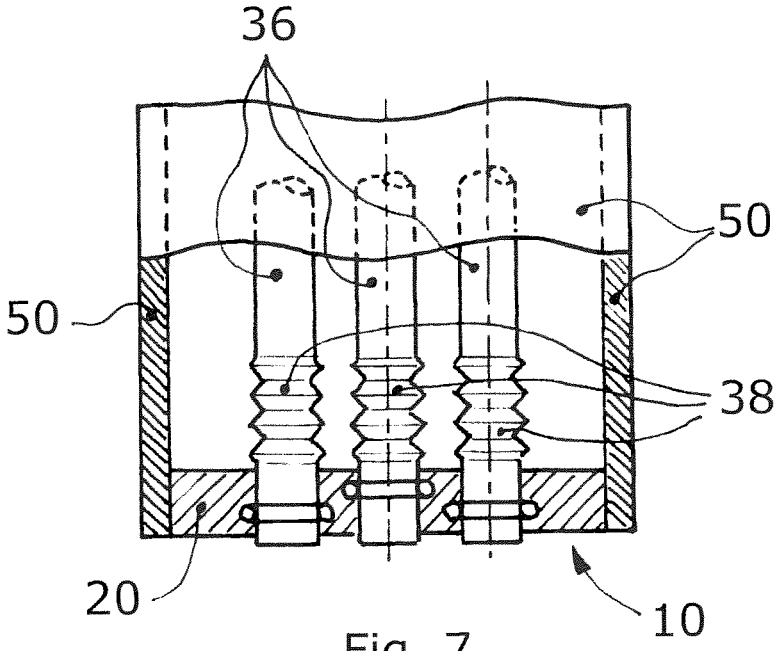
FIG. 7 shows a further embodiment of the tube sheet manufacturing method with tubes having a corrugated part.

FIG. 7 shows a further embodiment of the manufacturing method according to the invention similar to FIG. 4, but further including casting a heat exchanger shell 50 together with a stack of tubes 40 having a corrugated part 38 in each tube 36 to the tube sheet 10 during the second step of the manufacturing process.

Figure 8:
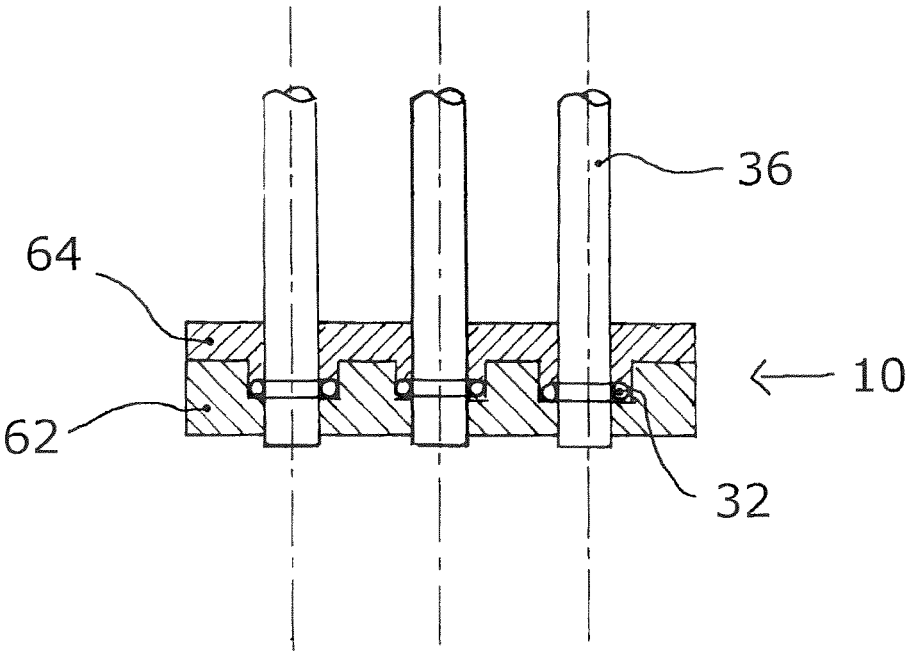
FIG. 8 shows a further embodiment of the tube sheet manufacturing method comprising a metal insert in the mould.

FIG. 8 shows an alternative embodiment of the manufacturing method according to the invention similar to FIG. 4, but wherein the tube sheet 10 is constituted by a metal part 62 and a plastic part 64, for example comprising epoxy resin. Both parts 62, 64 are bonded to each other into a single tube sheet. In manufacturing this tube sheet, the metal part 62 is arranged as a metal insert 62 in the mould. Then, the ends of the heat exchanger tubes 36, which are provided with the O-rings 32, are arranged in the mould by inserting said ends into through holes in the metal insert 62. The O-rings 32 seal the tube walls of the ends of the heat exchanger tubes 36 with respect to the metal insert 62 such that the tube sheet material to be casted in the mould does not enter the heat exchanger tubes 36 during casting of the tube sheet material. After casting of the tube sheet material and hardening thereof, the hardened tube sheet material, the metal insert, and the heat exchanger tube with the embedded O-rings are removed from the mould.

The invention can also be described by the following clauses:

1. Heat exchanger tube sheet (10) for holding heat exchanger tubes (36) in a sealed manner, the sheet (10) comprising a body (20) of a plastic material having a first main surface (22) and an opposite second main surface (24), the body (20) comprising a plurality of through holes (26), each through hole (26) being defined by a peripheral hole wall (28) extending from the first main surface (22) to the opposite second main surface (24), and the peripheral hole wall (28) being provided with a peripheral recess (30), and wherein a resilient sealing element (32) is accommodated in the peripheral recess (30), the sealing element (32) protruding from the peripheral recess (30) into the through hole (26).

2. Heat exchanger tube sheet according to clause 1, wherein the through holes (26'; 26") extend in the body (20) substantially parallel to each other, and wherein the peripheral recesses (30") of adjacent through holes (26'; 26") are staggered with respect to each other in the axial direction of the through holes (26'; 26").

3. Heat exchanger tube sheet according to clause 2, wherein in projection the peripheral recesses (30") of adjacent through bores (26; 26") mutually overlap partially.

4. Heat exchanger tube sheet according to one of the preceding clauses, wherein the plastic material of the body (20) comprises an epoxy resin and/or a composite material, such as an alumina reinforced epoxy resin or fibre reinforced epoxy resin.

5. Heat exchanger (100) comprising a shell (50) having inlets (102; 106) and outlets (104; 108) for the fluids to be heat exchanged, a stack (40) of a plurality of heat exchanger tubes (36), and a heat exchanger tube sheet (10) according to one of the preceding clauses, wherein the heat exchanger tubes (36) each have at least one end (34) which is arranged in one of the through holes (26) such that the sealing element (32) clamps said end (34) in a sealed manner.

6. Heat exchanger according to clause 5, wherein the heat exchanger tubes (36) are made of a material that does not bind to the plastic material of the body (20) of the heat exchanging tube sheet (10) and that does not bind to the material of the sealing elements (32).

7. Heat exchanger according to clause 5 or 6, wherein the heat exchanger tubes (36) comprise polypropylene.

8. Heat exchanger according to one of clauses 5-7, wherein the outer surface of the heat exchanger tubes (36) is provided with a non-binding coating.

9. Heat exchanger according to one of clauses 5-8, wherein each heat exchanger tube (36) is provided with a corrugated part (38) in its longitudinal direction.

10. Method of manufacturing a heat exchanger tube sheet (10), comprising the steps of a) arranging sealing elements (32) at predetermined positions in a mould (42); and b) casting a tube sheet material in the mould (42) for covering the sealing elements (32)

c) hardening the tube sheet material in the mould (42).

11. Method according to clause 10, wherein step a) comprises a1) arranging the sealing elements (32) on respective ends (34) of heat exchanger tubes (36);

a2) arranging said ends (34) in the mould (42); and a3) sealing said ends (34).

12. Method according to clause 11, wherein the mould (42) comprises a bottom (44), and wherein the bottom (44) is made from a flexible material, for example a material comprising silicones, and wherein step a3) comprises abutting said ends (34) against the bottom (44) of the mould (42).

13. Method according to clause 11, wherein step a3) comprises casting a sealing material, for example comprising silicons, into the mould (42) for covering an end portion of said ends (34), hardening the sealing material covering the end portions of said ends (34), and wherein the tube sheet material is cast onto the hardened sealing material, and wherein after step c) the heat exchanger tubes (36), the hardened sealing material and the hardened tube sheet material are integrally removed from the mould, and wherein the end portions of said ends (34) are cut so as to remove the hardened sealing material.

14. Method according to one of the clauses 10-13, wherein the tube sheet material comprises a plastic material, for example an epoxy resin and/or a composite material, such as an alumina reinforced epoxy resin or fibre reinforced epoxy resin.

15. Method according to one of the clauses 10-14, wherein the heat exchanger tubes (36) are made of a material that does not bind to the tube sheet material.

One or more of the features of the above clauses and/or one of more of the features described above in the introduction and description of the figures can be applied, separately and in any combination of features, to one or more the features of the claims.

The invention claimed is:

1. Method of manufacturing a heat exchanger tube sheet, comprising:

arranging sealing elements on respective ends of heat exchanger tubes, vertically arranging said ends of the heat exchanger tubes having the sealing elements at predetermined positions in a mould, sealing said ends of the heat exchanger tubes such that a tube sheet material to be casted in the mould does not enter the heat exchanger tubes during casting of the tube sheet material, casting the tube sheet material in the mould for covering the sealing elements, hardening of the tube sheet material in the mould, wherein a metal insert is arranged in the mould, wherein the metal insert comprises a plurality of through holes, and wherein end portions of said ends of the heat exchanger tubes having the sealing elements are inserted into the through holes of the metal insert, and wherein, when the end portions of said ends have been inserted into the through holes of the metal insert, said ends of the heat exchanger tubes are sealed by the sealing elements sealing the heat exchanger tubes and the metal insert with respect to each other, and wherein the tube sheet material is cast onto the metal insert for covering the sealing elements and portions of the heat exchanging tubes extending above the sealing elements, and wherein the through holes each comprise a lower portion having a first internal diameter, a connection portion extending radially from the lower portion, and an upper portion extending from the connecting portion and having a second internal diameter which is greater than the first internal diameter, and wherein the external diameter of the heat exchanger tubes is smaller than the first internal diameter, and wherein the external diameter of the sealing elements arranged on said ends of heat exchanger tubes is greater than the first internal diameter and smaller than the second internal diameter, and wherein the tube sheet material is casted onto the upper portions of the through holes, directly contacting an upper surface of the sealing elements.

2. Method according to claim 1, wherein the heat exchanger tubes are made from stainless steel and the metal insert comprises aluminium.

3. Method according to claim 1, wherein the heat exchanger tubes are made of a material that does not bind to the tube sheet material during casting and hardening the tube sheet material in the mould.

4. Method according to claim 1, wherein the heat exchanger tubes are made of a material that does not bind to the material of the sealing elements during casting and hardening the tube sheet material in the mould.

5. Method according to claim 1, further comprising integrally removing the tube sheet comprising the metal insert and the hardened tube sheet material and the heat exchanger tubes with the sealing elements from the mould.

6. Method according to claim 1, wherein the mould comprises a bottom, and wherein the bottom is made from a flexible material, and wherein said ends of the heat exchanger tubes are sealed by abutting said ends against the bottom of the mould.

7. Method according to claim 6, wherein the flexible material comprises-silicones.

8. Method according to claim 1, wherein said ends of the heat exchanger tubes are sealed by casting a sealing material, into the mould for covering end portions of said ends, and hardening of the sealing material covering the end portions of said ends, and wherein the tube sheet material is cast onto the hardened sealing material, and wherein, after hardening of the tube sheet material in the mould, the heat exchanger tubes, the hardened sealing material and the hardened tube sheet material are integrally removed from the mould, and wherein subsequently the hardened sealing material is removed.

9. Method according to claim 8, wherein the sealing material comprises silicones.

10. Method according to claim 8, wherein the hardened sealing material is removed by pulling off the hardened sealing material from the hardened tube sheet material and said ends or by cutting the hardened sealing material together with end portions of said ends.

11. Method according to claim 1, wherein the tube sheet material comprises a plastic material.

12. Method according to claim 11, wherein the plastic material is an epoxy resin.

13. Method according to claim 1, wherein the mould comprises metal.

14. Method according to claim 13, wherein the metal is iron, steel or stainless steel.

15. Method according to claim 1, wherein the tube sheet material comprises a composite material.

16. Method according to claim 15, wherein the composite material comprises an epoxy resin.

17. Method according to claim 16, wherein the epoxy resin is an alumina reinforced epoxy resin or fibre reinforced epoxy resin.

18. Heat exchanger tube sheet obtainable by the method as claimed in claim 1.

19. Heat exchanger according to claim 1, wherein the heat exchanger tubes comprise plastic.

20. Heat exchanger according to claim 19, wherein the plastic is polypropylene.

* * * * *